US009985342B2

(12) United States Patent
Lee et al.

(10) Patent No.: US 9,985,342 B2
(45) Date of Patent: May 29, 2018

(54) ANTENNA MOUNTING UNIT FOR VEHICLE

(71) Applicants: Hyundai Motor India Engineering Pvt. Ltd., Hyderabad (IN); Hyundai Motor Company, Seoul (KR); Kia Motors Corporation, Seoul (KR)

(72) Inventors: Jin Woo Lee, Seoul (KR); Seung Hai Hwang, Gyeonggi-do (KR); Jong Dae Kim, Seoul (KR); Jack Joseph, Hyderabad (IN); Mariyala Satish Reddy, Hyderabad (IN)

(73) Assignees: Hyundai Motor Company, Seoul (KR); Kia Motors Corporation, Seoul (KR); Hyundai Motor India Engineering Pvt. Ltd., Hyderabad (IN)

( * ) Notice: Subject to any disclaimer, the term of this patent is extended or adjusted under 35 U.S.C. 154(b) by 83 days.

(21) Appl. No.: 15/040,660

(22) Filed: Feb. 10, 2016

(65) Prior Publication Data

US 2017/0170551 A1 Jun. 15, 2017

(30) Foreign Application Priority Data

Dec. 11, 2015 (IN) ..... 4077/DEL/2015

(51) Int. Cl.
*H01Q 1/32* (2006.01)
*H01Q 1/12* (2006.01)

(52) U.S. Cl.
CPC ..... *H01Q 1/3275* (2013.01); *H01Q 1/1214* (2013.01)

(58) Field of Classification Search
CPC ... H01Q 1/3275; H01Q 1/1207; H01Q 1/1214
See application file for complete search history.

(56) References Cited

U.S. PATENT DOCUMENTS

| | | | | |
|---|---|---|---|---|
| 6,486,841 | B1 | 11/2002 | Imahigashi | |
| 2003/0231140 | A1* | 12/2003 | Haussler | H01Q 1/3275 343/888 |
| 2007/0013594 | A1* | 1/2007 | Yegin | H01Q 1/3275 343/713 |
| 2013/0140847 | A1* | 6/2013 | Altes | H01Q 1/1214 296/152 |
| 2014/0285394 | A1* | 9/2014 | Truthan | H01Q 1/242 343/860 |

FOREIGN PATENT DOCUMENTS

| | | | |
|---|---|---|---|
| JP | 5114325 | B2 | 1/2013 |
| KR | 10-2007-0030340 | A | 3/2007 |
| KR | 10-1243389 | B1 | 3/2013 |
| KR | 10-1456229 | B1 | 10/2014 |

* cited by examiner

*Primary Examiner* — Robert Karacsony
(74) *Attorney, Agent, or Firm* — Mintz Levin Cohn Ferris Glovsky and Popeo, P.C.; Peter F. Corless

(57) ABSTRACT

A roof antenna mounting unit for a vehicle is provided. The roof antenna mounting unit is mounted in a mounting aperture formed in a roof of a vehicle and fixes an antenna. The mounting unit includes a fastening member having a molding portion and a fastening portion that is inserted into the mounting aperture. An upper cover is integrally coupled to the fastening member by injection molding to surround an outer circumferential surface of the molding portion and is disposed at an upper side extraneous to the roof. A sealing member is interposed between the roof and the upper cover and a fixing nut is mounted on the fastening portion inserted into the mounting aperture at a lower side in the roof.

13 Claims, 5 Drawing Sheets

ANTENNA MOUNTING UNIT FOR VEHICLE

CROSS REFERENCE TO RELATED APPLICATION

The present application claims priority to Indian Patent Application No. 4077/DEL/2015, filed Dec. 11, 2015, the entire contents of which is incorporated herein for all purposes by this reference.

BACKGROUND (a) Field of the Invention

The present invention relates to an antenna mounting unit for a vehicle, and more particularly, to an antenna mounting unit for a vehicle, which is mounted on a vehicle roof and has a reduced weight and manufacturing cost.

(b) Description of the Related Art

In general, vehicle antennas are classified into a manual type of antenna, a glass type of antenna, a micro type of antenna, and the like. Among the antennas, the manual type of antenna is disadvantageous in terms of external appearance since it is exposed to the exterior of the vehicle, and the glass type of antenna has a drawback in that receiving performance thereof is low. Accordingly, recently, the micro type of antenna has been applied to the vehicle.

The micro type of antenna has a smaller external shape, such that an external appearance thereof is not affected even though it is exposed to the exterior of the vehicle, and it includes a circuit board for amplifying signals, thus improving receiving performance in comparison with the glass type of antenna. The micro type of antenna is mounted on a vehicle roof using an antenna mounting unit that includes a base, a cover, a plurality of holders, and a plurality of bolts and nuts.

However, there are problems in that the antenna mounting unit for a vehicle in the related art has complex constituent elements and thus degrades assembly properties, and manufacturing costs of the antenna mounting unit are increased. In addition, there are also problems in that the weight of the antenna mounting unit is increased due to the respective constituent elements being made of different materials, and the antenna cannot be fixed on the roof due to torsional torque that occurs when the nuts are fastened.

The above information disclosed in this section is merely for enhancement of understanding the background of the invention and therefore it may contain information that does not form the prior art that is already known in this country to a person of ordinary skill in the art.

SUMMARY

The present invention provides an antenna mounting unit for a vehicle, in which a fastening member and an upper cover are integrated, thereby more stably mounting the upper cover on a vehicle roof, and reducing weight and manufacturing costs thereof.

An exemplary embodiment of the present invention provides an antenna mounting unit for a vehicle mounted in a mounting aperture formed in a roof of a vehicle and the mounting unit is configured to fix an antenna. The antenna mounting unit may include: a fastening member having a molding portion, and a fastening portion inserted into the mounting aperture; an upper cover integrally coupled to the fastening member to surround an outer circumferential surface of the molding portion, and disposed at an upper side exterior to the roof; a sealing member interposed between the roof and the upper cover; and a fixing nut mounted on the fastening portion inserted into the mounting aperture at a lower side in the roof.

The fastening member may have at least one coupling groove and at least one torque groove integrally formed around the outer circumferential surface of the molding portion. The coupling groove may be formed in a hexahedron shape which includes five substantially straight surfaces disposed in the molding portion to be perpendicular to each other and adjacent to each other, and one opened curved side that is disposed at the outer circumference of the molding portion. The coupling grooves may be spaced apart from each other in a longitudinal direction of the molding portion, and formed at both sides that are opposite to each other based on a center C of the fastening member.

The torque grooves may be disposed at both sides and may be spaced apart from each other based on a virtual center line L that runs through the center C of the fastening member. Additionally, the torque grooves and the coupling grooves may be alternately formed to be spaced apart from each other in the longitudinal direction of the molding portion. The torque grooves may be formed to be opposite to each other based on the center C of the fastening member and formed in a radial direction in the outer circumferential surface of the molding portion. Further, the torque groove may be formed in a pentahedron shape which includes four substantially straight surfaces disposed in the molding portion to be perpendicular to each other and adjacent to each other, and one opened curved side disposed at the outer circumference of the molding portion.

Screw threads may be formed by a threading process on an outer circumferential surface of the fastening portion in a longitudinal direction of the fastening portion. The fastening member may be made of a polyamide (PA) material. The upper cover may be made of an acrylic styrene acrylonitrile (ASA) material. The sealing member may be made of a thermoplastic vulcanizate (TPV) material. The fixing nut may be made of a polyamide (PA) material.

BRIEF DESCRIPTION OF THE DRAWINGS

The above and other objects, features and advantages of the present disclosure will be more apparent from the following detailed description taken in conjunction with the accompanying drawings.

DESCRIPTION OF SYMBOLS

Figure 1:
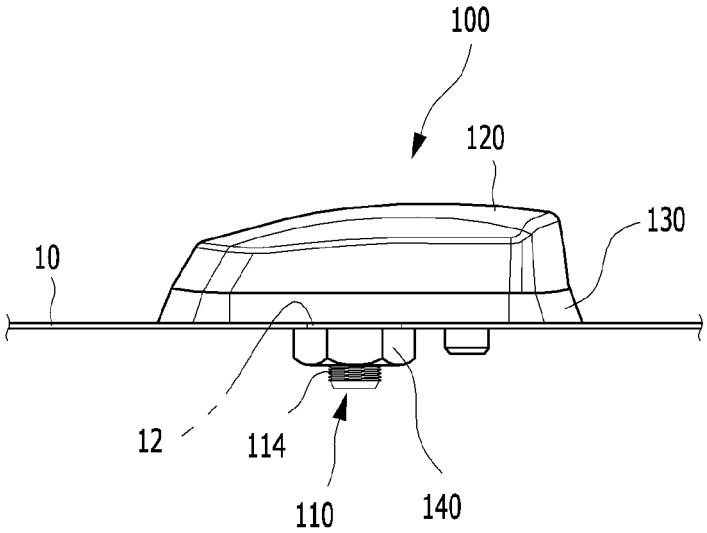
FIG. 1 is a side view of an antenna mounting unit for a vehicle according to an exemplary embodiment of the present invention.

100: Roof antenna mounting unit
110: Fastening member
112: Molding portion

112*a*: Coupling groove
112*b*: Torque groove
114: Fastening portion
120: Upper cover
130: Sealing member
140: Fixing nut

DETAILED DESCRIPTION

Hereinafter, an exemplary embodiment of the present invention will be described in detail with reference to the accompanying drawings. The exemplary embodiment disclosed in the present specification and the configurations illustrated in the drawings are merely exemplary embodiments of the present invention, and do not fully represent the technical spirit of the present invention. Accordingly, it should be appreciated that various equivalents and modified examples capable of substituting for them can be made.

A part irrelevant to the description will be omitted to clearly describe the present invention, and the same or similar constituent elements will be designated by the same reference numerals throughout the specification. The size and thickness of each component illustrated in the drawings are arbitrarily shown for better understanding and ease of description, but the present invention is not limited thereto. Thicknesses of several portions and regions are enlarged for clear expressions.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. In addition, the term "unit", "means", "part", "member", or the like, which is described in the specification, means a unit of a comprehensive configuration that performs at least one function or operation.

Figure 2:
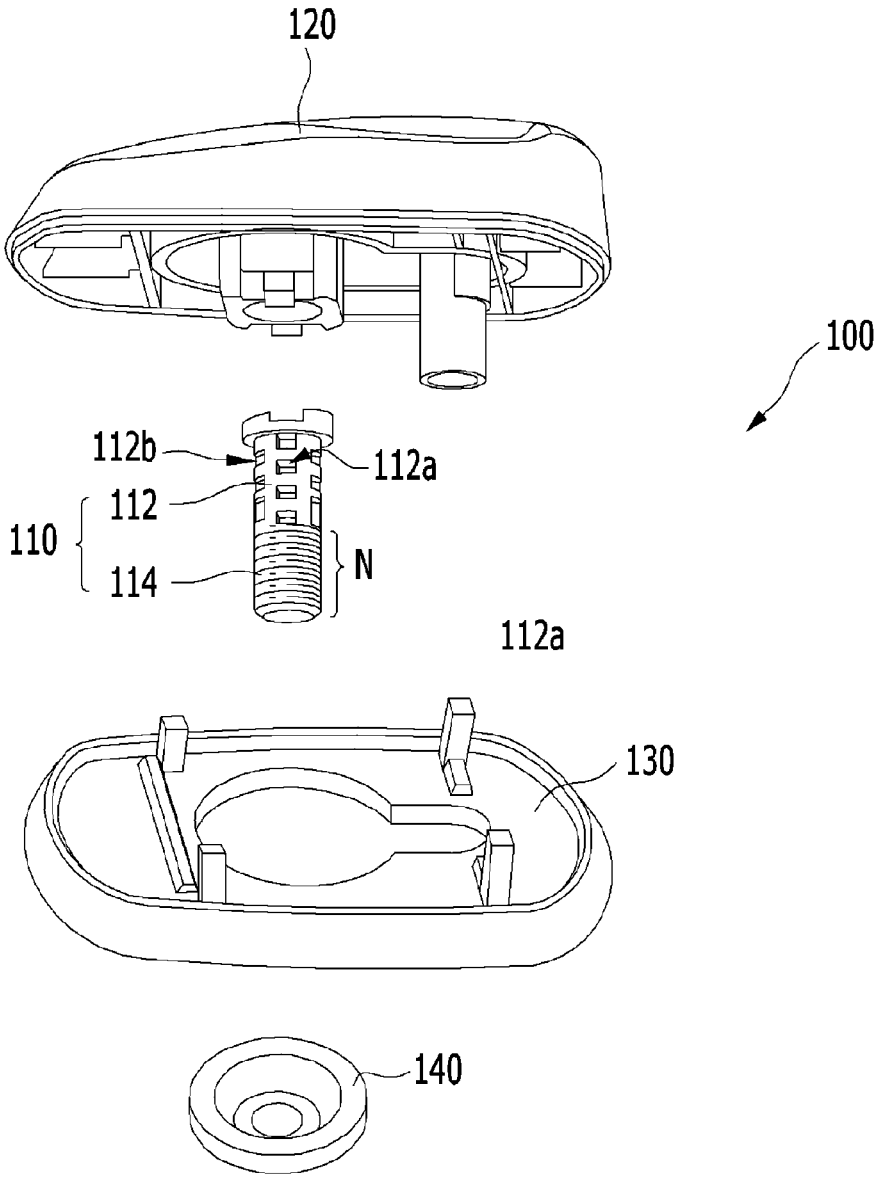
FIG. 2 is a detailed view of the antenna mounting unit for a vehicle according to the exemplary embodiment of the present invention.
Figure 3:
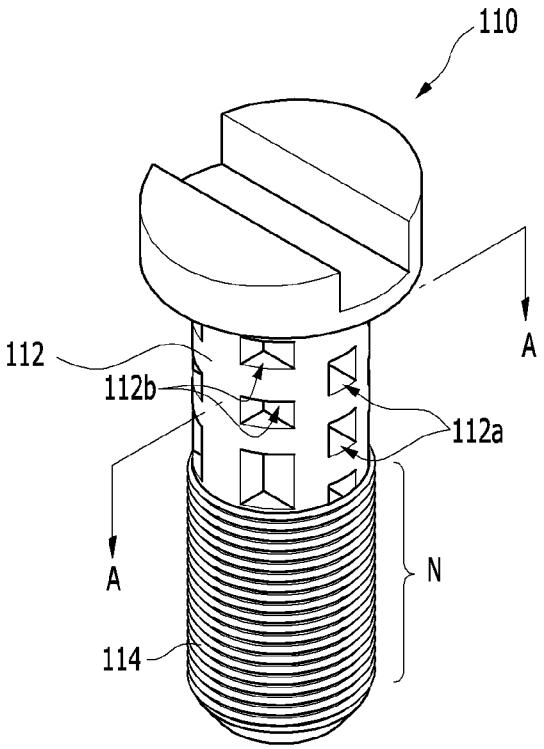
FIG. 3 is a view of a fastening member applied to the antenna mounting unit for a vehicle according to the exemplary embodiment of the present invention.
Figure 4:
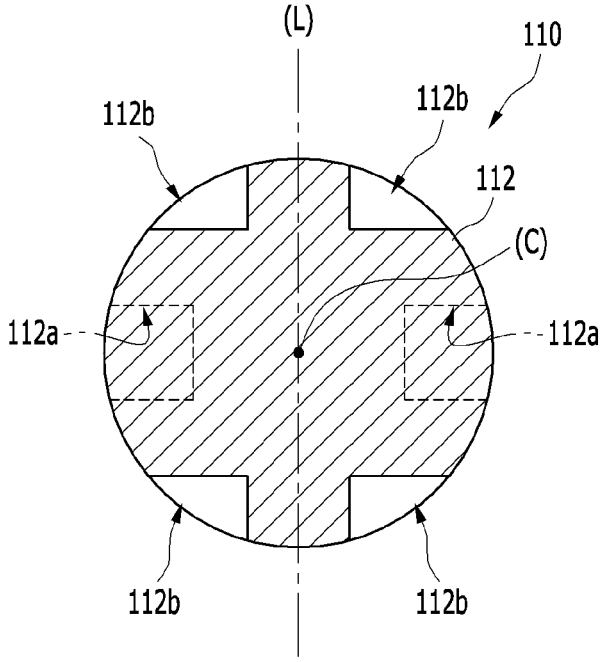
FIG. 4 is a cross-sectional view taken along line A-A of FIG. 3 according to the exemplary embodiment of the present invention.
Figure 5:
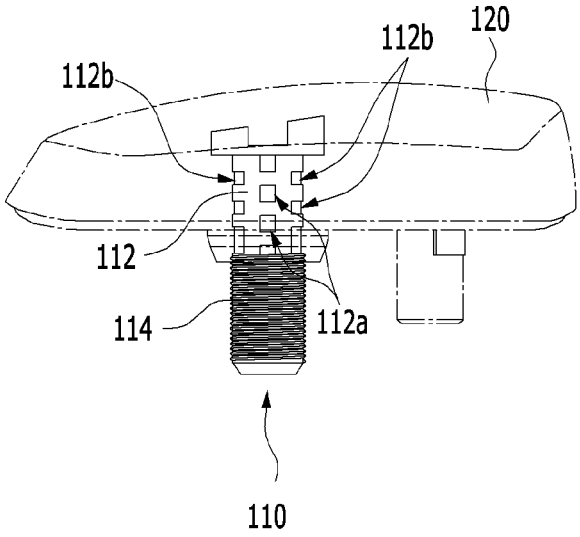
FIG. 5 is a projection view illustrating a state in which the fastening member is coupled to an upper cover in the antenna mounting unit for a vehicle according to the exemplary embodiment of the present invention.

FIGS. 1 and 2 are a side view and a detailed view of an antenna mounting unit for a vehicle according to an exemplary embodiment of the present invention, FIG. 3 is a view of a fastening member applied to the antenna mounting unit for a vehicle according to the exemplary embodiment of the present invention, FIG. 4 is a cross-sectional view taken along line A-A of FIG. 3, and FIG. 5 is a projection view illustrating the fastening member coupled to an upper cover in the antenna mounting unit for a vehicle according to the exemplary embodiment of the present invention.

An antenna mounting unit 100 for a vehicle according to the exemplary embodiment of the present invention may be mounted within a mounting aperture 12 formed in a roof 10 of a vehicle, and may be configured to fix a micro type of antenna to the roof of the vehicle. As illustrated in FIGS. 1 and 2, the antenna mounting unit 100 for a vehicle may include a fastening member 110, an upper cover 120, a sealing member 130, and a fixing nut 140.

In particular, the fastening member 110 may include a molding portion 112 and a fastening portion 114, and the fastening portion 114 may be inserted into the mounting aperture 12. The fastening member 110, which is configured as described above, may be made of a polyamide (PA) material that is one of engineering plastics. The fastening member 110 may have at least one coupling groove 112*a* and at least one torque groove 112*b* integrally formed around an outer circumferential surface of the molding portion 112. Detailed structures of the coupling groove 112*a* and the torque groove 112*b* will be described below. Further, a plurality of screw threads N may be formed by a threading process on an outer circumferential surface of the fastening portion 114 in a longitudinal direction of the fastening portion 114.

In the present exemplary embodiment, the upper cover 120 may be integrally coupled to the fastening member 110 to surround the outer circumferential surface of the molding portion 112 by injection molding, and may be disposed at an upper side outside the roof 10. The upper cover 120 may be made of an acrylic styrene acrylonitrile (ASA) material. The ASA material is one of plastic materials which have high weather-resistant properties and impact strength, and has excellent fluidity when the ASA material is molded, and since the ASA material is a technology that is publicly and widely known in the art, a detailed description thereof will be omitted.

The sealing member 130 may be interposed between the roof 10 and the upper cover 120. Further, the sealing member 130 may prevent foreign substances and moisture from entering between the roof 10 and the upper cover 120. In particular, the sealing member 130 may be made of a thermoplastic vulcanizate (TPV) material which is an advanced material that is substituted for a typical rubber product, has mechanical, heat-resistance, and chemically resistance properties, is reusable, and is made of polypropylene and EPDM rubber, and since the TPV material is a technology that is publicly and widely known in the art, a detailed description thereof will be omitted.

Furthermore, the fixing nut 140 may be mounted on the fastening portion 114 inserted into the mounting aperture 12 at a lower side in the roof 10. In other words, the fixing nut 140 may be screw-fastened to the screw threads N formed on the fastening portion 114, thereby fixing the upper cover 120 to the roof 10. Similar to the fastening member 110, the fixing nut 140 may be made of a polyamide (PA) material. The coupling groove 112*a* and the torque groove 114*a*, formed in the molding portion 112 of the fastening member 110, will be described below with reference to FIGS. 3 and 4.

First, the coupling groove 112*a* may be formed in a hexahedron shape having five substantially straight surfaces disposed in the molding portion 112 to be perpendicular to each other and adjacent to each other, and one opened curved side disposed at the outer circumference of the molding portion 112. The coupling grooves 112*a* may be spaced apart from each other in a vertical direction of the molding portion 112. The coupling grooves 112*a* may be formed at both sides that are opposite to each other based on a center C of the fastening member 110, respectively. Further, the torque grooves 112*b* may be disposed at both sides, and may be spaced apart from each other based on a virtual center line L that runs through the center C of the fastening member 110. In other words, the torque grooves 112*b* may be formed to be opposite to each other based on the center C of the fastening member 112 and may be formed in a radial direction in the outer circumferential surface of the molding portion 112.

The torque grooves 112*b* and the coupling grooves 112*a* may be alternately formed to be spaced from each other in the vertical direction of the molding portion 112. In addition, the torque groove 112*b* may be formed in a pentahedron shape having four substantially straight surfaces disposed in the molding portion 112 to be perpendicular to each other and adjacent to each other, and one opened curved side disposed at the outer circumference of the molding portion 112.

As illustrated in FIG. 5, the coupling grooves 112*a*, which are configured as described above, allow the upper cover 120 to be fitted into the coupling grooves 112*a* when the upper cover 120 is injection-molded with the fastening member 110, thereby increasing coupling force between the fastening member 110 and the upper cover 120. In addition, the torque grooves 112*b* may be integrally coupled to the upper cover 120 when the upper cover 120 is fitted into the torque grooves 112*b* and the upper cover 120 is injection-molded, thereby improving resistance force against torsional torque that occurs when the fixing nut 140 is fastened to the fastening portion 114.

Therefore, when the roof antenna mounting unit 100 for a vehicle according to the exemplary embodiment of the present invention, which is configured as described above, is applied, the upper cover 120 may be integrally coupled to the molding portion 112 of the fastening member 110 by injection molding, thereby more stably mounting the upper cover 120 on the roof 10 of the vehicle and improving fastening force and water tightness (e.g., a watertight seal). In addition, the respective constituent elements may be made of plastic materials, thereby reducing weight and manufacturing costs.

In addition, the upper cover 120 may be integrally coupled to the fastening member 110 by injection molding when a part of the upper cover 120 is fitted into the coupling grooves 112*a* and the torque grooves 112*b* formed in the fastening member 110, thereby improving fastening force between the fastening member 110 and the upper cover 120, and improving resistance force against torsional torque that occurs when the fixing nut 140 is fastened.

The present invention has been described with reference to the exemplary embodiment and the drawings, but the present invention is not limited thereto. The described exemplary embodiment may be changed or modified by those skilled in the art to which the present invention pertains within the technical spirit of the present invention and within the scope equivalent to the appended claims.

What is claimed is:

1. A roof antenna mounting unit for a vehicle, mounted in a mounting aperture formed in a roof of a vehicle and configured to fix an antenna, the antenna mounting unit comprising:

a fastening member having a molding portion, and a fastening portion inserted into the mounting aperture;

an upper cover integrally coupled to the fastening member to surround an outer circumferential surface of the molding portion, and disposed at an upper side extraneous to the roof;

a sealing member interposed between the roof and the upper cover; and a fixing nut mounted on the fastening portion inserted into the mounting aperture at a lower side in the roof, wherein the fastening member has at least one coupling groove and at least one torque groove integrally formed around the outer circumferential surface of the molding portion.

2. The roof antenna mounting unit of claim 1, wherein the coupling groove is formed in a hexahedron shape having five straight surfaces disposed in the molding portion to be perpendicular to each other and adjacent to each other, and one opened curved side disposed at the outer circumference of the molding portion.

3. The roof antenna mounting unit of claim 1, wherein the coupling grooves are spaced apart from each other in a longitudinal direction of the molding portion, and formed at both sides that are opposite to each other based on a center of the fastening member.

4. The roof antenna mounting unit of claim 3, wherein the torque grooves are disposed at both sides, which are spaced apart from each other based on a virtual center line that runs through the center of the fastening member.

5. The roof antenna mounting unit of claim 3, wherein the torque grooves and the coupling grooves are alternately formed to be spaced apart from each other in the longitudinal direction of the molding portion.

6. The roof antenna mounting unit of claim 1, wherein the torque grooves are formed to be opposite to each other based on the center of the fastening member and formed in a radial direction in the outer circumferential surface of the molding portion.

7. The roof antenna mounting unit of claim 1, wherein the torque groove is formed in a pentahedron shape having four straight surfaces disposed in the molding portion to be perpendicular to each other and adjacent to each other, and one opened curved side disposed at the outer circumference of the molding portion.

8. The roof antenna mounting unit of claim 1, wherein a plurality of screw threads are formed by a threading process on an outer circumferential surface of the fastening portion in a longitudinal direction of the fastening portion.

9. The roof antenna mounting unit of claim 1, wherein the fastening member is made of a polyamide material.

10. The roof antenna mounting unit of claim 1, wherein the upper cover is made of an acrylic styrene acrylonitrile material.

11. The roof antenna mounting unit of claim 1, wherein the sealing member is made of a thermoplastic vulcanizate material.

12. The roof antenna mounting unit of claim 1, wherein the fixing nut is made of a polyamide material.

13. The roof antenna mounting unit of claim 1, wherein the upper cover is integrally coupled to the fastening member by injection molding when a part of the upper cover is fitted into the coupling grooves and the torque grooves formed in the fastening member.

* * * * *